United States Patent [19]

Lozio

[11] 4,106,802

[45] Aug. 15, 1978

[54] SELF-LOCKING BAND

[75] Inventor: Battista Lozio, Milan, Italy

[73] Assignee: Lozio Battista e Figli S.p.A., Milan, Italy

[21] Appl. No.: 773,755

[22] Filed: Mar. 2, 1977

[30] Foreign Application Priority Data

Jun. 25, 1976 [IT] Italy ..... 24716 A/76

[51] Int. Cl.[2] ..... B65D 33/34

[52] U.S. Cl. ..... 292/320

[58] Field of Search ..... 292/317, 320, 307, 322, 292/318, 316

[56] References Cited

U.S. PATENT DOCUMENTS

| | | | |
|---|---|---|---|
| 954,271 | 4/1910 | Edgar | 292/320 |
| 3,149,869 | 9/1964 | Chamberlin | 292/320 |
| 3,290,080 | 12/1966 | Dawson | 292/322 |
| 3,834,748 | 9/1974 | Lonnee | 292/320 |

*Primary Examiner*—Richard E. Moore

*Attorney, Agent, or Firm*—Karl F. Ross

[57] ABSTRACT

A self-locking band, to be used as a seal or a tag holder, has an integral elastomeric body which forms a flexible stem terminating at one end in a double hook and on the other end in a flat sleeve formed with two pairs of internal barbs of dovetail shape facing in opposite directions. The stem is attached midway to the sleeve, allowing its hook to be inserted into the sleeve from either end thereof for interengagement with the corresponding pair of barbs.

9 Claims, 5 Drawing Figures

SELF-LOCKING BAND

FIELD OF THE INVENTION

My present invention relates to a self-locking band, or single-use tie, serving as a seal for a package, a holder for a price tag or a similar device designed to prevent unauthorized detachment of certain items from associated articles.

BACKGROUND OF THE INVENTION

Such self-locking bands generally comprise a flexible link terminating in a male extremity or tongue and in an opposite female extremity or socket into which the tongue can be matingly inserted, the socket being provided with internal formations which prevent a withdrawal of the inserted tongue. Thus, a loop formed by the interengaging male and female extremities cannot be opened except by forcible rupture.

In my prior Italian Pat. No. 924,832 there has been disclosed a band of this description whose tongue consists of stiff plastic material engageable by elastically deformable barbs in the associated socket. While such a band is well suited for its intended purpose, it has the drawback of allowing only one mode of interfitting of the two extremities. Instances arise, however, in which it would be convenient for a user to have alternative ways of aligning the two extremities with each other prior to closure of the loop, on account of the peculiar configuration of the article to be tied.

OBJECT OF THE INVENTION

The object of my present invention, therefore, is to provide an improved band of the character set forth which offers such alternative modes of interfitting.

SUMMARY OF THE INVENTION

In accordance with my present invention, the female extremity of the link is a sleeve with two open ends internally provided with oppositely facing resilient barbs which are positioned to coact with the male extremity and prevent its withdrawal upon insertion thereof through either of these ends.

In such a band the end of the link remote from the male extremity is advantageously fastened to the sleeve at a point midway between the open ends of the latter, thus forming with it a T-junction which allows the ends of the link to approach each other at right angles rather than in an aligned position. This permits the use of shorter links in forming a loop around a given article since the link need no longer be stretched into such a position of alignment. Moreover, the user has a choice of closing the loop on one or the other side of the "T". Furthermore, the link may be a relatively stiff stem of elastomeric material, e.g. polyethylene or polypropylene, inasmuch as it need not be bent through a full 360°; such a stem will therefore be less liable to accidental destruction.

BRIEF DESCRIPTION OF THE DRAWING

The above and other features of my invention will now be described in detail with reference to the accompanying drawing in which.

SPECIFIC DESCRIPTION

Figure 1:
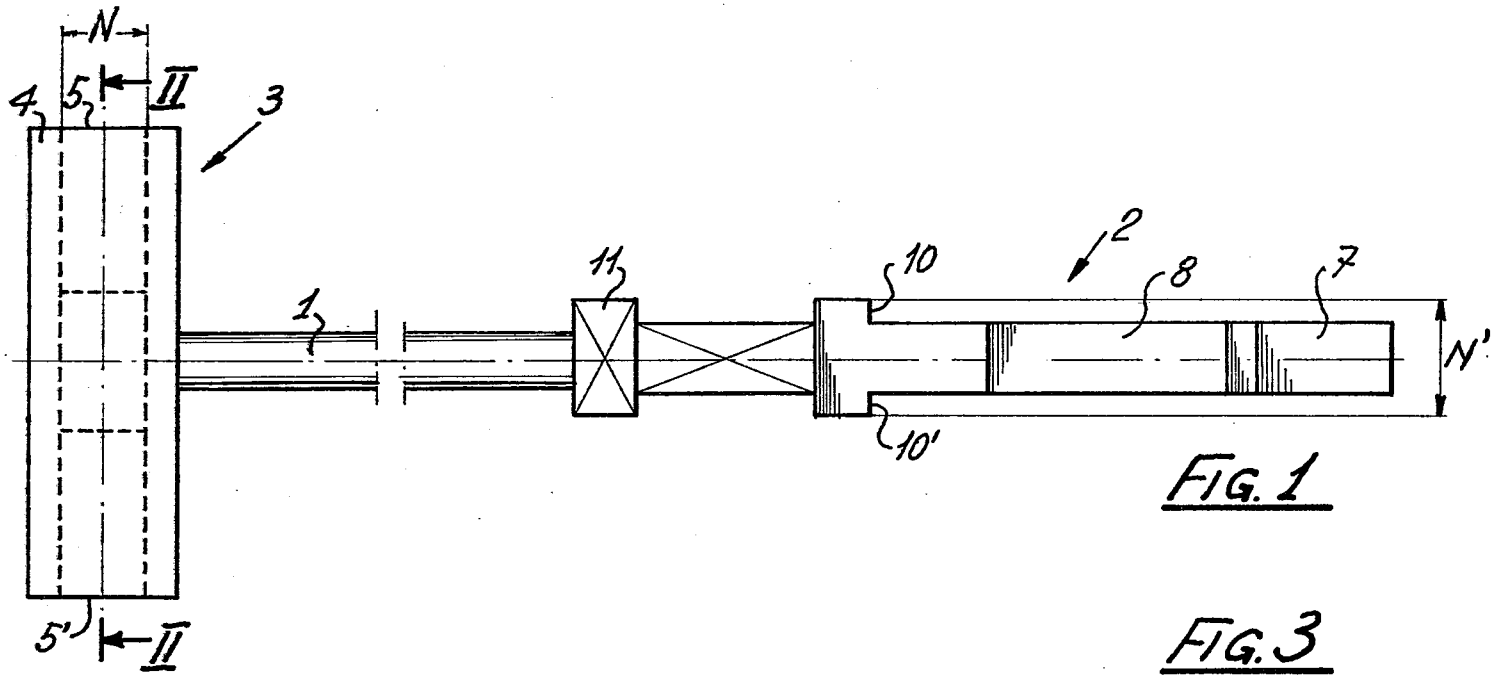
FIG. 1 is a side view of an improved self-locking band according to my invention.

The self-locking band shown in the drawing comprises a round stem of elastomeric material terminating in a male extremity or tongue 2 and a female extremity or socket 3 integral therewith. Socket 3 has a body 4 in the shape of a sleeve of rectangular cross-section with opposite open ends 5 and 5'; between these ends, along the minor sides of the rectangle, I provide two symmetrical internal projections 6, 6' of dovetail shape forming two pairs of barbs respectively pointing toward ends 5 and 5'.

Figure 5:
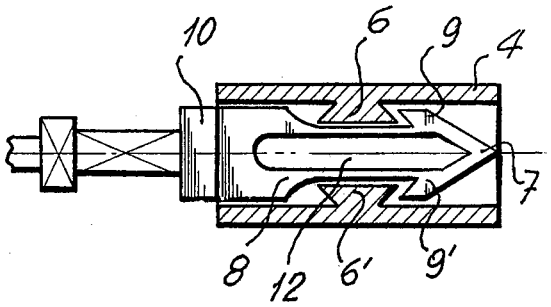
FIG. 5 is a cross-sectional view of the interlocked extremities of the band.

Extremity 2 is a flat tonge with an arrowhead 7 whose hooks or prongs 9 and 9' include with its shank 8 an acute angle $\alpha$ identical with the angles included between the flanks of dovetails 6, 6' and the walls of sleeve 4. The resiliency of these prongs and of the coacting barbs allows the interlocking of arrowhead 7 with dovetails 6 and 6', regardless of its direction of insertion, as illustrated in FIG. 5. Upon such insertion, an abutment consisting of two shoulders 10 and 10' at the rear of tongue 2 comes to rest against the end of the sleeve through which the tongue has been introduced, thereby blocking the interior of the sleeve so as to prevent any tampering with the connection from that side. At its opposite end, access to the coacting formations 6, 6' and 9, 9' is blocked by the shape of the arrowhead whose height and width are close to the corresponding dimensions of the interior of the sleeve.

A square block 11, separated from abutment 10, 10' by a reinforced stem portion 1' of square profile, serves as a handle in manipulating the tongue 2.

Figure 3:
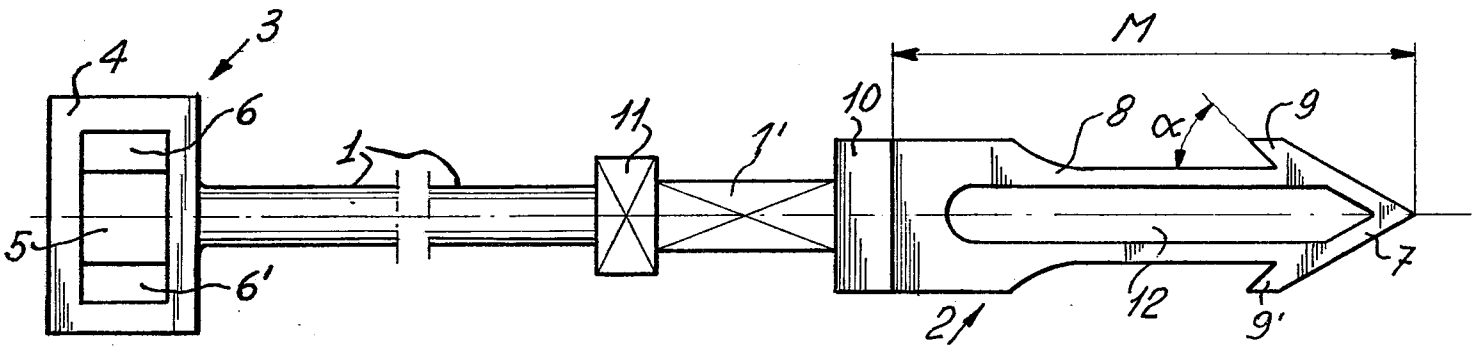
FIG. 3 is a top view of the band shown in FIG. 1.
Figure 2:
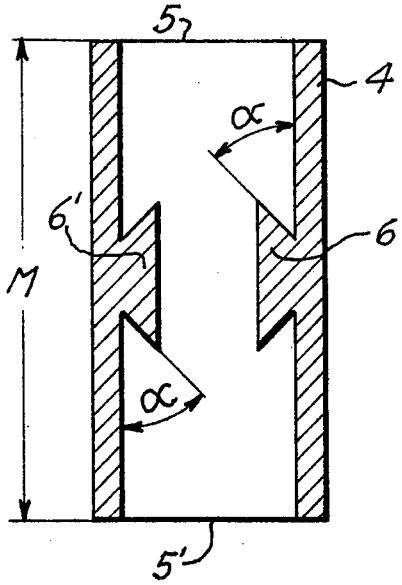
FIG. 2 is a cross-sectional view taken on the line II — II of FIG. 1.
Figure 4:
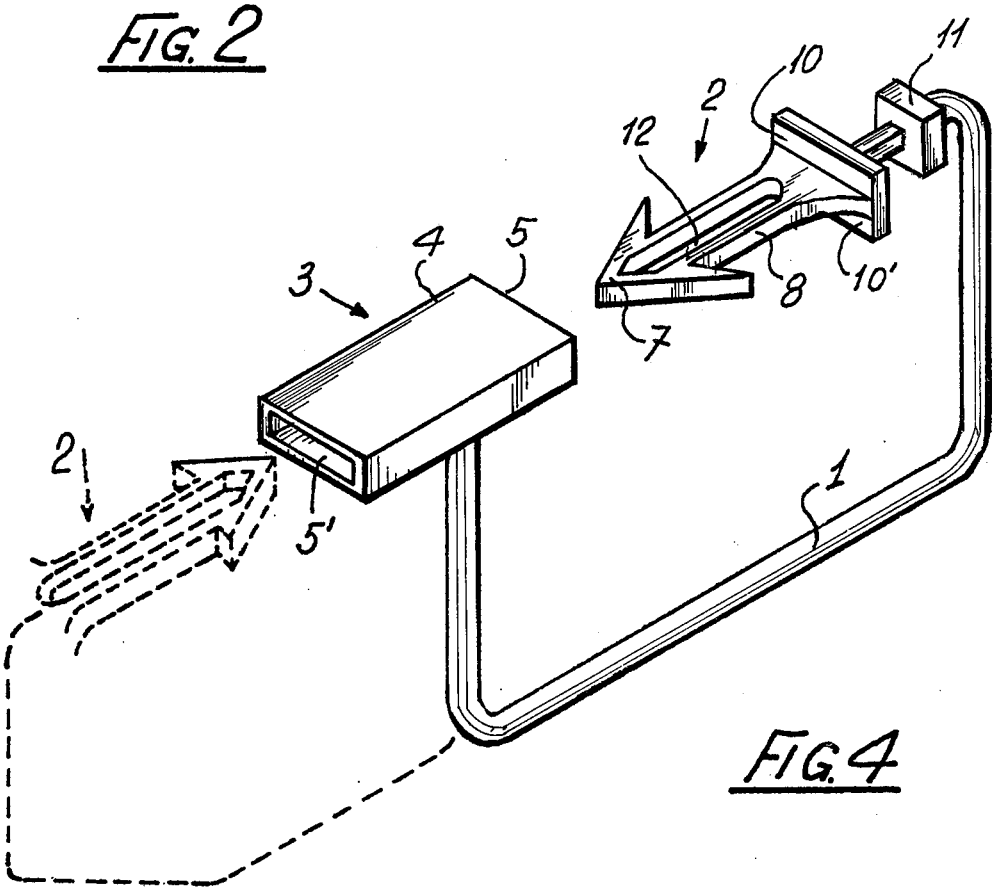
FIG. 4 is a perspective view of the band in a position of incipient loop closure.

A longitudinal slot 12, extending from near the tip of arrowhead 7 to the vicinity of shoulders 10 and 10', reduces the weight and increases the flexibility of the tongue for easier interfitting. The length M of the tongue, from its tip to the abutment 10, 10', substantially equals that of the sleeve 4 as seen in FIGS. 2 and 3; on the other hand, the combined height M' of shoulders 10 and 10' exceeds the internal height N of the sleeve and substantially equals its external height. The distance of prongs 9 and 9' from shoulders 10 and 10' corresponds approximately to the spacing of either pair of flanks of dovetails 6 and 6' from the remote end of the sleeve. As seen in FIG. 4, the width of shoulders 10 and 10' is about the same as that of the sleeve.

FIG. 4 clearly shows, in full lines, the insertion of tongue 2 into the end 5 of socket 3 and in dashed lines the alternative introduction of the tongue into end 5'. Naturally, once a choice has been made, the tongue will retain its selected position within the socket until the loop is forcibly broken, thereby preventing the reuse of the tie and evidencing its disengagement from the article to which it was originally attached.

The band 1, 2, 3 can be molded in one piece, though the tongue 2 may be given its final shape by stamping.

I claim:

1. A self-locking band comprising:

a flexible link with a hook-shaped extremity having the shape of a flat tongue terminating in an arrowhead; and a sleeve with two open ends secured to said link at a point remote from said extremity, said link being internally provided with oppositely facing resilient barbs positioned to coact with said extremity and prevent its withdrawal upon insertion thereof through either of said ends, said sleeve being of rectangular cross-section and provided with said barbs at both minor sides of the rectangle.

2. A band as defined in claim 1 wherein said barbs are formed by a pair of confronting dovetails at said minor sides symmetrically disposed midway within said sleeve and integral therewith.

3. A band as defined in claim 2 wherein said dovetails and said arrowhead have coacting flanks including identical angles with the centerlines of said sleeve and said link, respectively.

4. A band as defined in claim 2 wherein said tongue broadens rearwardly of said arrowhead into an abutment of a height exceeding a corresponding dimension of the interior of said sleeve, thereby blocking the insertion end thereof, said arrowhead having lateral undercuts engageable by said barbs and spaced from said abutment by a distance corresponding to the distance of the coacting barbs from the more remote end of said sleeve.

5. A band as defined in claim 4 wherein said abutment comprises a pair of shoulders having a rectangular outline substantially identical with that of said sleeve.

6. A band as defined in claim 4 wherein the length of said link from the tip of said arrowhead to sait abutment substantially equals the length of said sleeve.

7. A band as defined in claim 4 wherein said stem consists of elastic material, said tongue being longitudinally slotted between said arrowhead and said abutment.

8. A band as defined in claim 1 wherein said link is a stem of elastomeric material integral with said sleeve and said tongue.

9. A band as defined in claim 8 wherein said stem adjoins said sleeve at a point midway between said ends thereof.

* * * * *